US006123789A

United States Patent [19]

Nielson

[11] Patent Number: 6,123,789

[45] **Date of Patent: *Sep. 26, 2000**

[54] CASTABLE INFRARED ILLUMINANT COMPOSITIONS

[75] Inventor: Daniel B. Nielson, Brigham City, Utah

[73] Assignee: Cordant Technologies Inc., Salt Lake City, Utah

[ * ] Notice: This patent is subject to a terminal disclaimer.

[21] Appl. No.: 08/386,328

[22] Filed: Feb. 10, 1995

Related U.S. Application Data

[63] Continuation of application No. 07/913,842, Jul. 15, 1992.

[51] Int. Cl.[7] ..... C06B 45/10

[52] U.S. Cl. ..... 149/19.1; 149/19.4; 149/19.5; 149/61; 149/22; 149/116; 102/335; 102/336

[58] Field of Search ..... 149/19.1, 19.4, 149/19.5, 61, 22, 116; 102/335, 336

[56] References Cited

U.S. PATENT DOCUMENTS

| | | | |
|---|---|---|---|
| 2,909,418 | 10/1959 | Pearsall | 52/2 |
| 3,411,964 | 11/1968 | Douda | 149/19 |
| 3,475,237 | 10/1969 | Lane et al. | 149/22 |
| 3,617,403 | 11/1971 | Johnson | 149/19 |
| 3,673,013 | 6/1972 | Lane et al. | 149/116 |
| 3,677,842 | 7/1972 | Doris | 149/19.1 |
| 3,706,611 | 12/1972 | Hastings | 149/44 |
| 3,733,223 | 5/1973 | Lohkamp | 149/116 |
| 3,888,177 | 6/1975 | Tyroler | 149/116 |
| 3,895,578 | 7/1975 | Shaw et al. | 102/336 |
| 3,951,705 | 4/1976 | Manicinelli et al. | 149/41 |
| 3,986,907 | 10/1976 | Dillehay | 149/19.1 |
| 4,078,954 | 3/1978 | Bernardy | 149/116 |
| 4,204,895 | 5/1980 | Webster | 149/22 |
| 4,406,228 | 9/1983 | Boettcher et al. | 102/513 |
| 4,719,857 | 1/1988 | Spring | 102/335 |
| 5,056,435 | 10/1991 | Jones et al. | 102/336 |
| 5,317,163 | 5/1994 | Obkircher | 102/334 |

FOREIGN PATENT DOCUMENTS

| | | |
|---|---|---|
| 1277528 | 10/1970 | United Kingdom . |
| 1515039 | 6/1976 | United Kingdom . |
| 1573645 | 4/1977 | United Kingdom . |
| 2 176 178 | 12/1986 | United Kingdom . |

*Primary Examiner*—Edward A. Miller
*Attorney, Agent, or Firm*—Pillsbury Madison & Sutro LLP

[57] ABSTRACT

Compositions are provided which, when burned, produce significant levels of infrared radiation, but only limited levels of visible radiation. The basic components of the compositions include a binder, an oxidizer, and a fuel, where the binder also acts the fuel. Preferred oxidizers include those compounds which produce large quantities of infrared radiation when the flare composition is burned. Such oxidizers include potassium nitrate, cesium nitrate, rubidium nitrate, and combinations of these compounds. Selection of the binder is important in order to provide the composition with the desirable characteristics identified above. The binder of the present invention does not produce significant soot. At the same time, the binder serves to form a composition which is processible, avoids chunking, and is compatible with the oxidizers used. It has been found that polymer binders which include relatively short carbon chains (1–6 continuous carbon atoms) are preferred. Examples of such polymers include polyesters, polyethers, polyamides, and polyamines.

18 Claims, 7 Drawing Sheets

CASTABLE INFRARED ILLUMINANT COMPOSITIONS

This application is a continuation of U.S. application Ser. No. 07/913,842, filed Jul. 15, 1992, for CASTABLE INFRARED ILLUMINANT COMPOSITIONS.

BACKGROUND

1. The Field of the Invention

The present invention is related to illuminant compositions which emit significant quantities of infrared radiation. More particularly, the present invention is related to castable infrared illuminant compositions which exhibit high initial burn rates, burn cleanly, and emit relatively small quantities of visible light in proportion to the infrared radiation emitted.

2. Technical Background

There is a need in various situations for an ability to see clearly at night, or during periods of substantially reduced sunlight. Such situations may, for example, include search and rescue operations, police surveillance, and military operations. In these types of situations, it is often important that key personnel have the ability to see clearly, even though there is limited sunlight.

In order to solve the problem of visibility at night, or during periods of substantially reduced sunlight, devices have been developed which allow one to see based upon available infrared illumination, rather than visible light. While the infrared vision devices take on various configurations, perhaps the most common type of infrared vision devices are night vision goggles. These devices provide individual users with the ability to see much more clearly at night, while not significantly limiting the mobility of the individual user.

In order to facilitate the use of infrared vision devices, it has been found advantageous to enhance the available infrared radiation in the area of interest. In that regard, infrared emitting flare mechanisms have been developed. Such mechanisms have taken on a variety of configurations; however, the most widely used mechanisms comprise flares which emit relatively large quantities of infrared radiation in addition to any visible light that may be produced.

Infrared emitting flares are generally configured in much the same manner as visible light emitting flares. Such flares may provide infrared radiation at a single position on the ground, or they may provide such radiation above the ground. In the case of above-ground operation, the flare system includes an internal or external means of propulsion which allows the user to fire the flare in a desired direction. In addition, the flare itself includes a material which, when burned, produces significant quantities of infrared radiation. In general operation the flare is propelled over the area of interest and ignited. The emitted infrared radiation then greatly enhances the usefulness of infrared viewing devices, such as night vision goggles.

A number of problems have been encountered in the development of suitable infrared emitting compositions for use in such flares. For example, it will be appreciated that it is often desirable to provide an infrared emitting flare which does not emit excessive quantities of visible light. In situations where it is desirable to conduct operations under cover of night with a degree of secrecy, this capability is imperative. Excessive emission of visible light from the flare may alert individuals in the area to the existence of the flare, which may in turn significantly reduce the effectiveness of the overall operation.

It has been found with known infrared flare compositions that excessive visible light is in fact emitted. In that regard, the performance of infrared emitting devices can be judged by the ratio of the amount of infrared radiation emitted to the amount of visible light emitted. This ratio is found to be low for many conventional infrared emitting compositions, indicating a high proportion of visible light being emitted from the flare.

Another problem encountered in the use of infrared emitting compositions relates to the burn rate achieved. Many known compositions have burn rates which are lower than would desired, resulting in less infrared radiation than would be desired. In order to provide an effective flare, relatively high burn rates are required.

It is often observed that the burning (surface area) of the flare composition increases dramatically over time. This characteristic is also generally undesirable. In the case of an infrared emitting flare which is launched into the air, this means that less infrared radiation is emitted when the flare is high above the surface, while more infrared radiation is emitted while the flare is near the surface. Indeed, it is often Sound that the flare continues to burn after it has impacted with the ground.

It will be appreciated that this burn rate curve is just the opposite of that which would be generally desirable. It is desirable to have a high intensity infrared output when the flare is at its maximum altitude in order to provide good illumination of the ground. It is less critical to have high infrared output as the flare approaches the ground simply because the distance between the ground and the flare is not as great (illumination can be expressed by the equation $\text{Illumination}=(I\times 4\pi)/(4\pi R^2)$ where I is the intensity in watts/steradian, R is the distance in feet from the flare to the object being illuminated, and illumination is expressed in units of watts/feet$^2$). Ultimately, it is desirable that the flare cease operation before impact with the surface in order to reduce detection and obvious problems, such as fire, which may be caused when a burning flare impacts with the ground.

Another problem often encountered with known infrared emitting materials is "chunking out." This phenomenon relates to breakup or unbonding separation of the flare propellant grain during operation. In these situations it is found that large pieces of the infrared emitting composition may break away from the flare and fall to the ground. This is problematic because the flare fails to operate as designed when large pieces of the infrared producing composition are missing, the amount of infrared output over the subject location is curtailed, and falling pieces of burning flare material create a safety hazard.

It has also been found that the use of conventional flare compositions results in soot formation. Soot formation can adversely affect the operation of the flare device in several ways, including causing an increase in visible light emitted. When soot or carbon is heated it may radiate as a blackbody radiator. Soot formation is encountered primarily due to the fuels and binders employed in the infrared producing composition. Conventional infrared producing compositions have generally been unable to adequately deal with the problem of soot formation.

A further problem relates to aging of the IR emitting composition. It is often observed that known compositions substantially degrade over time. This is particularly true if the storage temperature is elevated. In some situations, it may be necessary to store these materials for long periods of time at temperatures at or above 120° F. This has not been readily achievable with known compositions.

In summary, known infrared emitting compositions have been found to be less than ideal. Limitations with existing materials have curtailed their effectiveness. Some of the problem areas encountered have included low overall burn rates, undesirable burn rate curves, chunking out, poor aging, and undesirable levels of visible emissions.

It would, therefore, be a significant advancement in the art to provide infrared emitting compositions which overcame some of the serious limitations encountered with known compositions. It would be an advancement in the art to provide compositions which provided high levels of infrared emissions, while limiting the level of visible light output. It would be another significant advancement in the art to provide such compositions which had acceptably high burn rates.

It would also be an advancement in the art to provide infrared emitting compositions which substantially eliminated soot formation and which also substantially eliminated chunking. It would also be an advancement in the art to provide compositions which did not readily degrade with age, even when stored at relatively elevated temperatures.

Such compositions and methods are disclosed and claimed herein.

BRIEF SUMMARY AND OBJECTS OF THE INVENTION

The present invention is related to novel and inventive compositions which produce significant quantities of infrared radiation when burned. At the same time, the compositions avoid many of the limitations of the existing art. The compositions have high burn rates, produce relatively little visible light in proportion to infrared radiation produced (in that they substantially avoid soot formation). The compositions also avoid common problems such as chunking and poor high temperature aging. Finally, the compositions are castable. That is, the compositions are capable of being poured in liquid form into a mold, then taking the shape of the mold without the application of excessive pressure.

The basic components of the compositions include a binder, an oxidizer, and a fuel. In the castable formulations disclosed herein, the binder may act as the fuel. Other optional ingredients may also be added in order to tailor the characteristics of the composition to a specific use. Such optional ingredients include combustion rate catalysts and heat producing materials.

As mentioned above, it is critical to reduce visible light produced. This severely limits the fuels that can be used. Boron and silicon have been used in small amounts and act well as heat sources and as combustion rate catalysts. Hydrocarbon fuels have been evaluated and many tend to produce soot, which can lead to high visible light output. The hydrocarbon fuels/binders used, therefore, must burn cleanly and provide nonluminous fragments that can burn with ambient air in the plume in order to increase the heat output and size of the radiation surface. At the same time, the material must serve to form a composition which is processible, castable, avoids chunking, and is compatible with the oxidizers used.

The hydrocarbon binders (polymers) that have proven to reduce soot formation include polyesters, polyethers, polyamines, polyamides; particularly those with short carbon fragments in the backbone, alternating with oxygen or nitrogen atoms. It has been found that polymer binders which include relatively short carbon chains (about 1–6 continuous carbon atoms) are preferred. These molecules do not generally produce significant soot. Further, the additional desirable features of the invention can be achieved using these materials.

Preferred oxidizers include those compounds which produce large quantities of infrared radiation when the flare composition is burned. Such oxidizers include potassium nitrate, cesium nitrate, rubidium nitrate, and combinations of these compounds. These oxidizers are chosen to contain a metal with characteristic radiation wavelength in the near infrared (0.700 to 0.900 microns). The primary radiation comes from this line, whose width has been greatly broadened by the thermal energy in the plume.

It is believed to be important to provide free metal (potassium, cesium, or rubidium) during the burning of the flare composition in order to produce significant levels of infrared radiation. These metals appear to augment one another when used in certain combinations.

Significantly, high levels of cesium nitrate in the composition are found to greatly increase performance. Cesium nitrate is found to provide several significant advantages. Cesium nitrate is found to accelerate the burn rate. In addition, cesium nitrate broadens the infrared spectral output and improves infrared efficiency. Accordingly, it is preferred that cesium nitrate form from about 10% to about 90%, by weight, of the overall composition. In particular, excellent results are achieved when cesium nitrate is added to make up from about 30% to about 90% of the composition.

It is found that the compositions of the present invention produce relatively high burn rate materials. Burnrates at ambient pressures in the range of from about 0.0300 to about 0.1500 inches/second, and even somewhat higher, are readily achievable using the present invention. The more preferred range is above about 0.060 inches/second. Conventionally, it has been found that burn rates in this range are not readily achievable.

The present invention maintains the capability of tailoring desired characteristics by selecting specific combinations of fuels, oxidizers, and binders. Thus, particular burn rates and burn rate curves can be produced, the ratio of infrared radiation to visible light can be optimized, and the general physical and chemical properties can be carefully selected. Thus, the present invention provides a flexible illuminant material.

Accordingly, it is a primary object of the present invention to provide infrared emitting compositions which overcome several of the serious limitations encountered with known compositions.

It is an object of the present invention to provide compositions which when burned produce high levels of infrared emissions, while limiting the level of visible light output.

It is also an object of the present invention to provide such compositions which have high burn rates.

It is another object of the present invention to provide infrared emitting compositions which produce only limited soot and, therefore, limited visible output.

It is a further object of the invention to provide compositions which substantially eliminate chunking.

It is a further object of the present invention to provide compositions which do not significantly degrade with age, even when stored at relatively elevated temperatures.

These and other objects and advantages of the invention will become apparent upon reading the following detailed description and appended claims.

BRIEF DESCRIPTION OF THE DRAWINGS

In order that the manner in which the above-recited and other advantages and objects of the invention are obtained, a more particular description of the invention briefly described above will be rendered by reference to the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
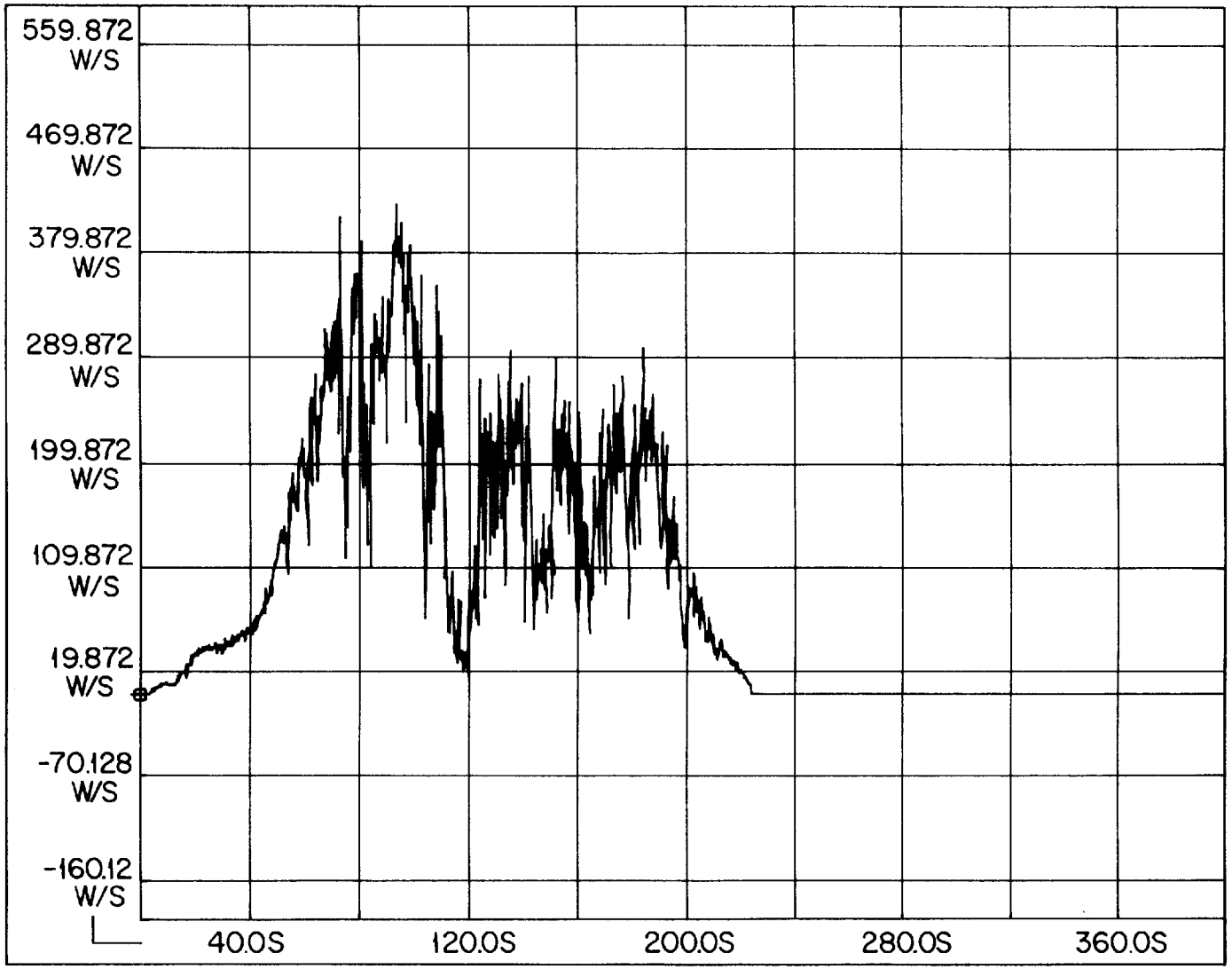
FIG. 1 is a graph of the infrared output of a composition within the scope of the present invention.

As mentioned above, the present invention is related to illuminant compositions which emit significant quantities of infrared radiation. The present invention also provides infrared illuminant compositions which exhibit high initial burn rates, burn cleanly, and emit relatively small quantities of visible light in relation to the infrared radiation emitted.

The compositions of the present invention are "castable" compositions. Castable compositions, as the title implies, are capable of being cast into a suitable mold without resorting to the application of excessive pressure. Thus, the material is easy to process and use in a flare device.

A typical castable composition within the scope of the present invention will include the following components in the following approximate percentages by weight:

| Materials | Percent |
|---|---|
| Oxidizing Salts(s) (such as Potassium Nitrate and Cesium Nitrate) | 40–90 |
| Boron | 0–20 |
| Silicon | 0–30 |
| Polymer Binder Premix | 10–50 |

In certain embodiments of the invention the oxidizer may comprise up to about 95% of the total composition. It is often preferred that at least 25% of the total composition comprises cesium nitrate, in that high levels of cesium nitrate results in the production of intense infrared radiation without significant visible light.

A specific example of a suitable binder in the composition is Formrez 17-80 polyester of Witco Chemical Corp. and more particularly, a curable polyester resin composition comprising by weight, from about 81% to about 83% to, preferably about 82.5% Formrez 17-80 polyester resin, about 15 to about 17%, preferably about 16.5% epoxy such as ERL 510 of Ciba-Geigy Corporation and about 0 to about 2%, and preferably 1% of a catalyst such as iron linoleate. More preferably, the binder may comprise about 82.5% Formrez 17-80 polyester resin, about 16.5% ERL epoxy and about 1% iron linoleate. Such a binder composition is referred to herein as WITCO 1780.

One exemplary embodiment of the present invention which provides excellent performance is formulated as follows:

| Materials | Percent |
|---|---|
| Potassium Nitrate | 37.0 |
| Cesium Nitrate | 35.0 |
| Silicon | 10.0 |
| Witco 1780 Binder Premix | 18.0 |

In this example, the Witco 1780 binder premix is a commercially available polyester resin based on triethyleneglycol and succinic acid, blended with an epoxide curing agent as described above. Notably, the cesium nitrate content is in excess of 25%, and the composition provides excellent performance.

It will be appreciated that equivalent materials may be substituted for those identified above. Specifically, the nitrate salts may be substituted for one another, depending on the specific characteristics desired. One such example is rubidium nitrate, which may be added to the compositions, or may be substituted for some or all of the identified oxidizers. The ultimate objective in that regard is to provide a strong oxidizer which is also capable of substantially contributing to the output of infrared radiation during burning of the composition. The identified compounds possess those characteristics.

As mentioned above, the use of high levels of cesium salts (such as cesium nitrate) increases the burning rate by as much as 400% and reduces visible output by up to 50%. This occurs while at the same time maintaining high levels of infrared light in the 700 to 1100 nm region. Thus, specifically tailored formulations may include high levels of cesium nitrate in order to achieve specific performance criteria. It is presently preferred that the composition include from about 10% to about 90% cesium nitrate, and in many cases from about 25% to about 90%. It will be appreciated that the cesium nitrate comprises a portion of the total oxidizing salt added to the composition.

As discussed above, the compositions also include a liquid polymer binder which may be cross-linked by reaction with an epoxy or isocyanate curing agent. The binder facilitates the formulation, processing, and use of the final composition. At the same time, the binder provides a source of fuel for the composition. Suitable binders in the present invention also insure a clean burning composition by substantially reducing soot formation.

Binders which are preferred in the present invention include polymers which have relatively short carbon chains (1–6 continuous carbon atoms) connected together by ether, amine, ester, or amide linkages (polyethers, polyamines, polyesters, or polyamides). Examples of such polymers include polyethylene glycol, polypropylene glycol, polybutylene oxide, polyesters, and polyamides. As mentioned above, one such polymer is Witco 1780, manufactured by Witco Corp. Other similar materials are well known to those skilled in the art and are commercially available.

It is also readily possible to add combustion rate catalysts and heat sources to the overall composition. These materials provide for further tailoring of the performance characteristics of the resulting composition. These materials, however, must also fit the other parameters of an acceptable composition such as producing little visible light and not contributing to the other undesirable characteristics identified herein. Two examples of such preferred materials include silicon and boron, while materials such as magnesium are not preferred because of their propensity to emit large quantities of visible light.

In the castable compositions described herein, boron is preferably added to constitute from about 0% to about 20%, by weight of the total composition. Silicon preferably makes up from about 0% to about 25% of the total composition.

One measure of a preferred composition is the ratio of infrared radiation to visible light produced during burning of the composition. Preferably the composition will have an IR/Vis. ratio of at least 3.50, and more preferably greater than 6.0. Indeed, ratios from 10 to 20 are achievable with the present invention. These levels of infrared output per unit of visible output have not been easily achievable using conventional compositions.

It is found that the compositions within the scope of the present invention also provide increased burn rates. Burn rates within the range of about 0.030 to about 0.150 inches per second are characteristic of the compositions of the present invention. As mentioned above, the preferred burn rates are in excess of 0.060 inches/second.

Compositions within the scope of the present invention also age and store well. This is a further feature which has not generally been available in known compositions. Compositions within the scope of the present invention may be stored at elevated temperatures (for example, 135° F.) for up to a year without significant degradation.

Compositions within the scope of the present invention can be formulated and prepared using known and conventional technology. Formulation techniques such as those generally employed in mixing and preparing propellant, explosive, and pyrotechnic compositions are preferably used in the preparation of the compositions within the scope of the present invention.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

In this example a composition within the scope of the present invention was formulated and tested. A castable composition was formulated. The formulation included relatively high levels of $CsNO_3$.

| Material | Percentage (by weight) |
|---|---|
| $CsNO_3$ | 70.0 |
| Silicon | 10.0 |
| Witco Binder Premix | 20.0 |

The Witco Binder Premix comprised a mixture of WITCO 1780 liquid polyester (triethyleneglycol succinate), manufactured by Witco Corp, blended with an appropriate amount of an epoxy curing agent to provide adequate cure.

The material was burned and the burn rate, output of visible light, and output of infrared radiation measured. Visible light was measured with a silicon photodiode with photopic response. Infrared light was measured using a silicon cell with a 695 nm cut on filter.

Tests on the composition yielded the following data:

| | | |
|---|---|---|
| WEB | 0.515 | inches |
| Burn rate | 0.0460 | in/sec |
| Burntime | 11.19 | seconds |
| Avg. IR | 741.2 | mV |
| Avg. Vis. | 45.34 | mV |
| IR/Vis. | 16.19 | |

All data represent the average of two runs.

As can be seen from the data presented above, the composition provides a useful infrared emitting composition. The composition provides a rapid burn rate, along with high IR output and extremely low visible output.

Example 2

In this Example a composition within the scope of the present invention was formulated and tested. The following ingredients were mixed to produce an infrared emitting composition:

| Material | Percentage (by weight) |
|---|---|
| $CsNO_3$ | 70.0 |
| Silicon | 10.0 |
| Witco premix (binder) | 20.0 |

The composition was a castable composition and was burned as a flare 2.75 inches in diameter, 13.1 inches in length, and weighing approximately 5.5 pounds. The following results were obtained and are the average for four separate tests:

| | | |
|---|---|---|
| Burntime | 191.4 | seconds |
| Burnrate | 0.0667 | in/sec |
| Avg. IR | 1.393 | v |
| Avg. Vis. | 121.5 | mV |
| Avg. IR | 266.3 | V sec. |
| Avg. Vis. | 23.15 | V sec. |
| IR/Vis. | 11.5 | |

Figure 2:
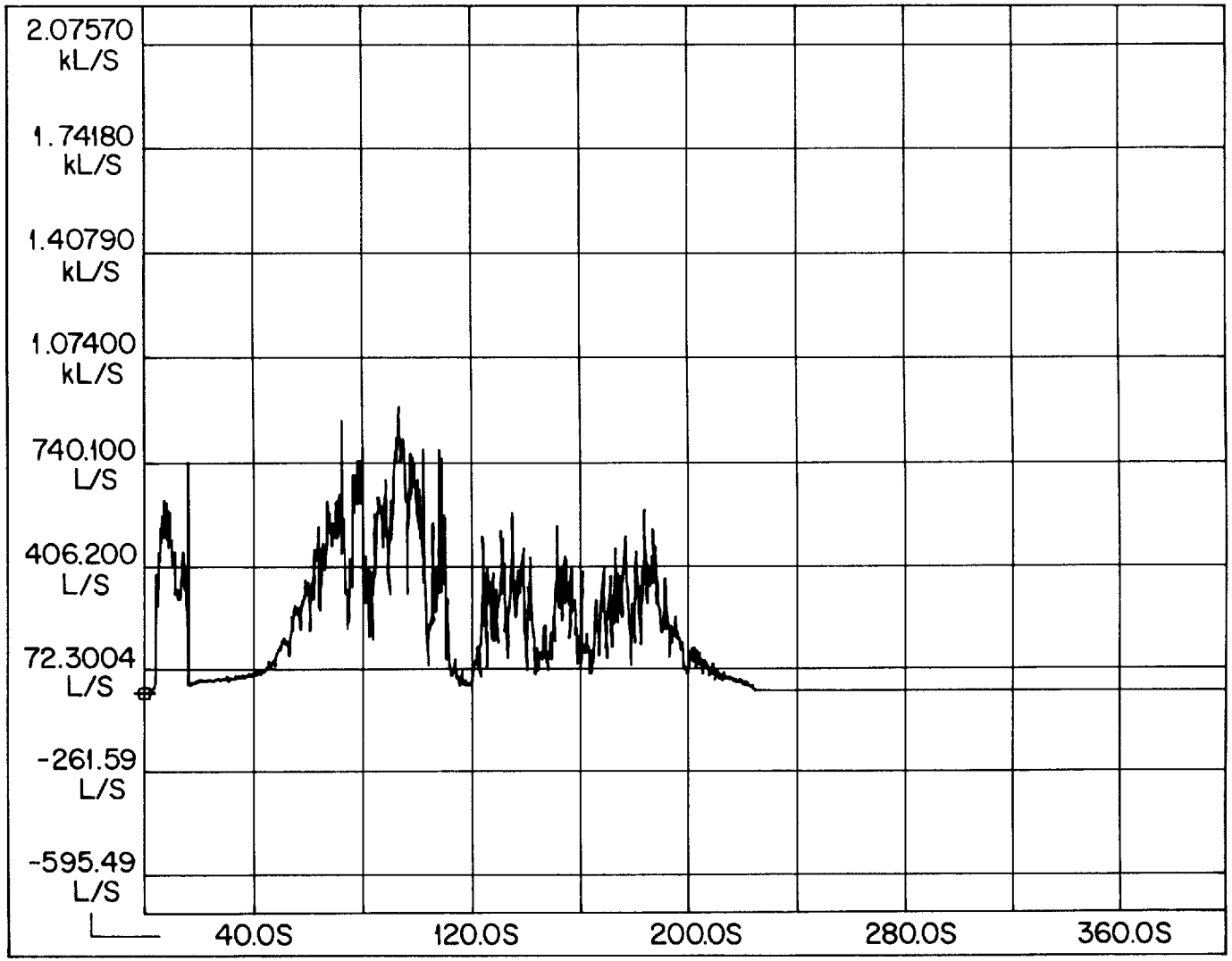
FIG. 2 is a graph of the visible output for the composition of FIG. 1.

FIG. 1 is plot of the output of infrared radiation over time for the composition. FIG. 2 is a plot of the output of visible radiation over time for the composition. It can be seen that a high level of infrared output was achieved shortly after burning commenced. This level was sustained over most of the operation of the sample, declining at the end of the burn. This burn rate curve is desirable. At the same time, the ratio of IR to visible was excellent.

It can be appreciated from the results achieved that an acceptable infrared emitting composition was produced and that the level of visible emissions was significantly lower than the level of infrared emissions.

Example 3

In this Example a composition within the scope of the present invention was formulated and tested. The following ingredients were mixed to produce an infrared emitting composition:

| Material | Percentage (by weight) |
|---|---|
| $CsNO_3$ | 35.0 |
| $KNO_3$ | 35.0 |
| Si | 10.0 |
| Witco premix | 20.0 |

This castable composition was burned and the following results were obtained and are the average for four separate tests:

| | |
|---|---|
| Burntime | 139.3 seconds |
| Burnrate | 0.0793 inches/second |
| Avg. IR | 1.857 v |
| Avg. Vis. | 155.8 mV |
| IR/Vis. | 11.9 |

Figure 3:
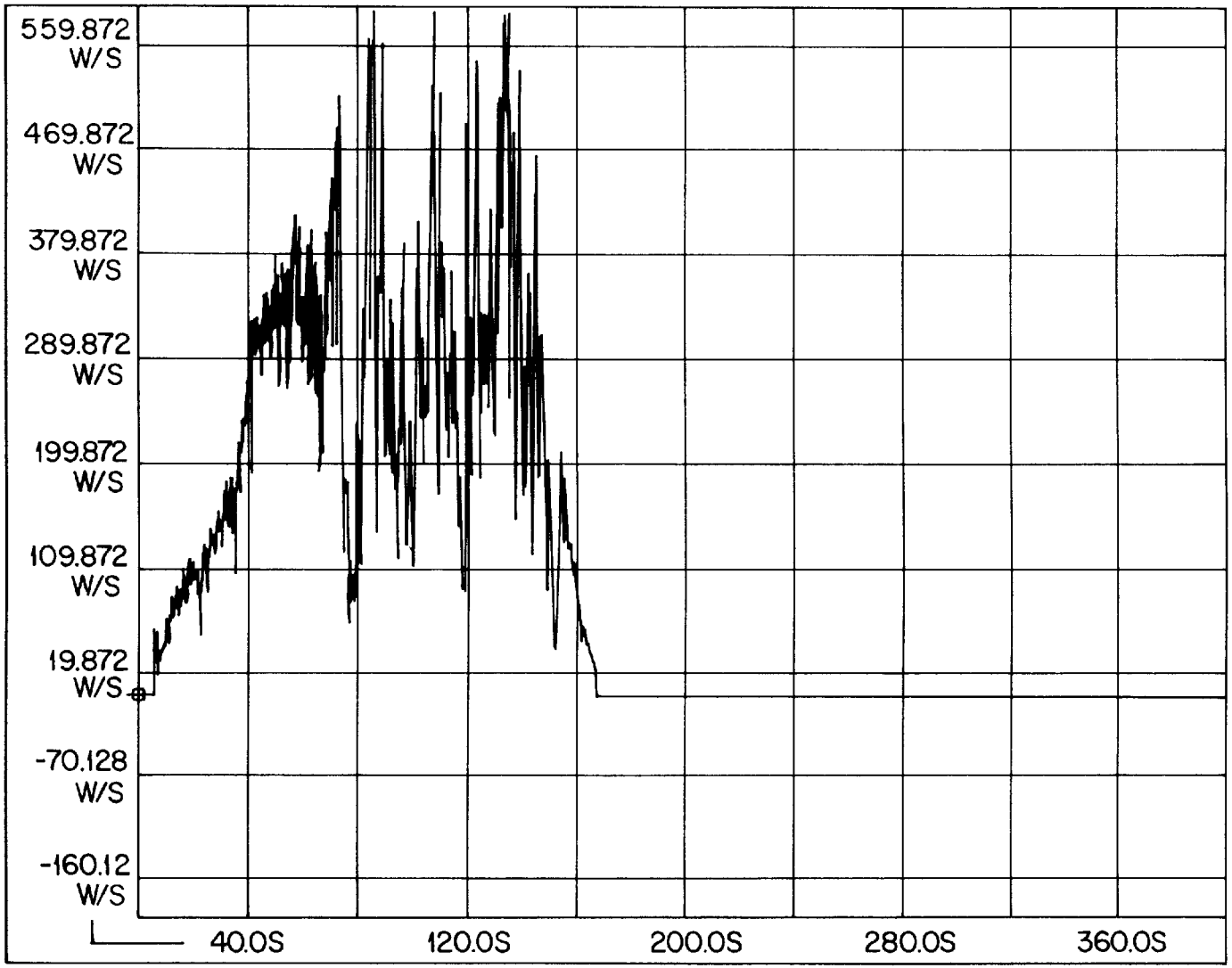
FIG. 3 is a graph of the infrared output of a composition within the scope of the present invention.
Figure 4:
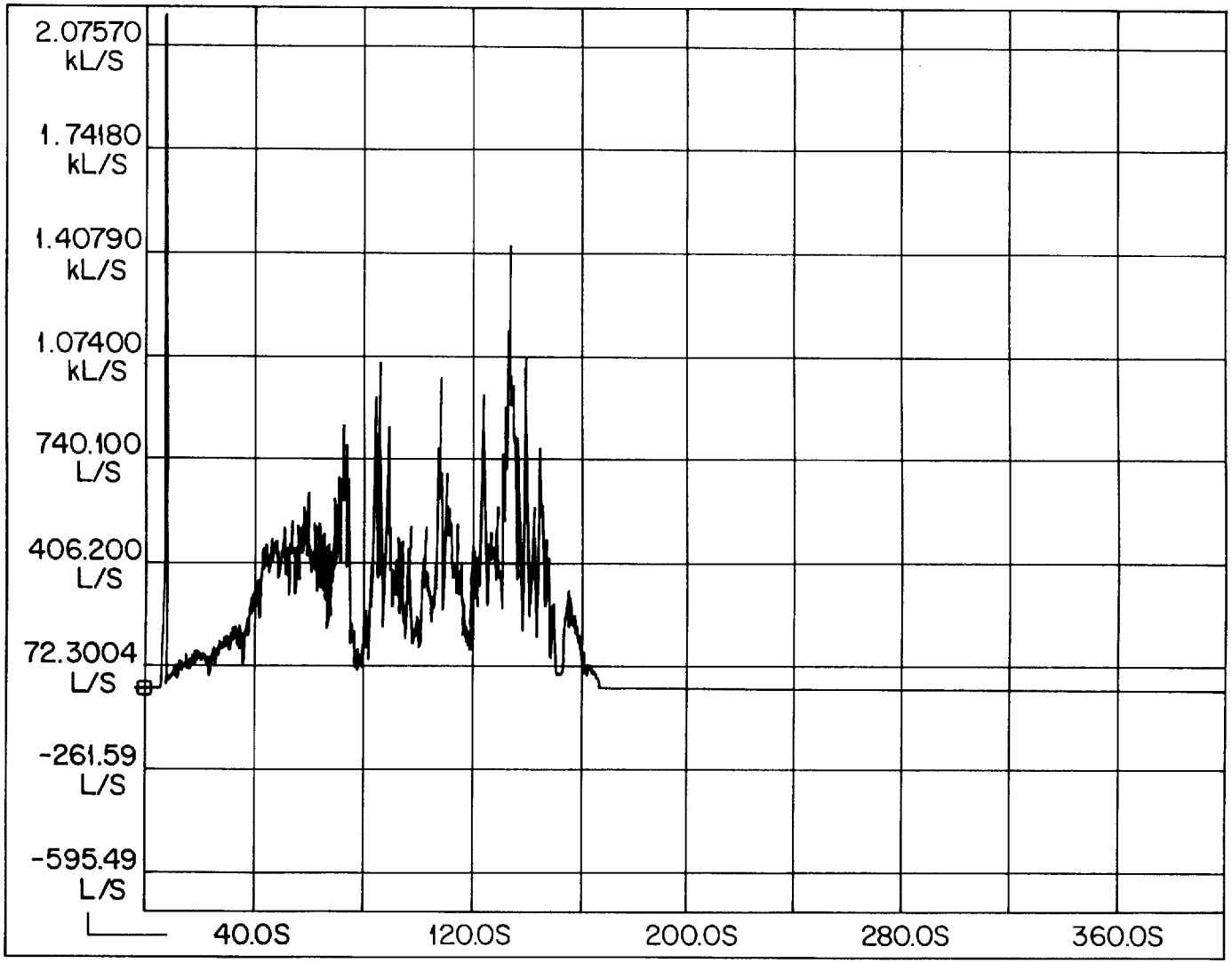
FIG. 4 is a graph of the visible output for the composition of FIG. 3.

FIG. 3 is plot of the output of infrared radiation over time for the composition. FIG. 4 is a plot of the output of visible radiation over time for the composition. It can be seen that a high level of infrared output was achieved shortly after burning commenced. This level was sustained over most of the operation of the sample, declining at the end of the burn. This burn rate curve is desirable. At the same time, the ratio of IR to visible was excellent.

It can be appreciated from the results achieved that an acceptable infrared emitting composition was produced and that the level of visible emissions was significantly lower than the level of infrared emissions.

Example 4

In this Example a composition within the scope of the present invention was formulated and tested. The following ingredients were mixed to produce an infrared emitting composition:

| Material | Percentage (by weight) |
|---|---|
| $CsNO_3$ | 70.0 |
| Si | 10.0 |
| Witco premix | 20.0 |

The composition was burned and the following results were obtained and are the average for four separate tests:

| | |
|---|---|
| Burntime | 14.79 seconds |
| Burnrate | 0.0381 inches/sec. |
| Avg. IR | 606.0 mv |
| Avg. Vis. | 38.65 mV |
| Avg. IR | 9.05 V sec. |
| Avg. Vis. | 0.584 V sec. |
| IR/Vis. | 15.50 |

Figure 5:
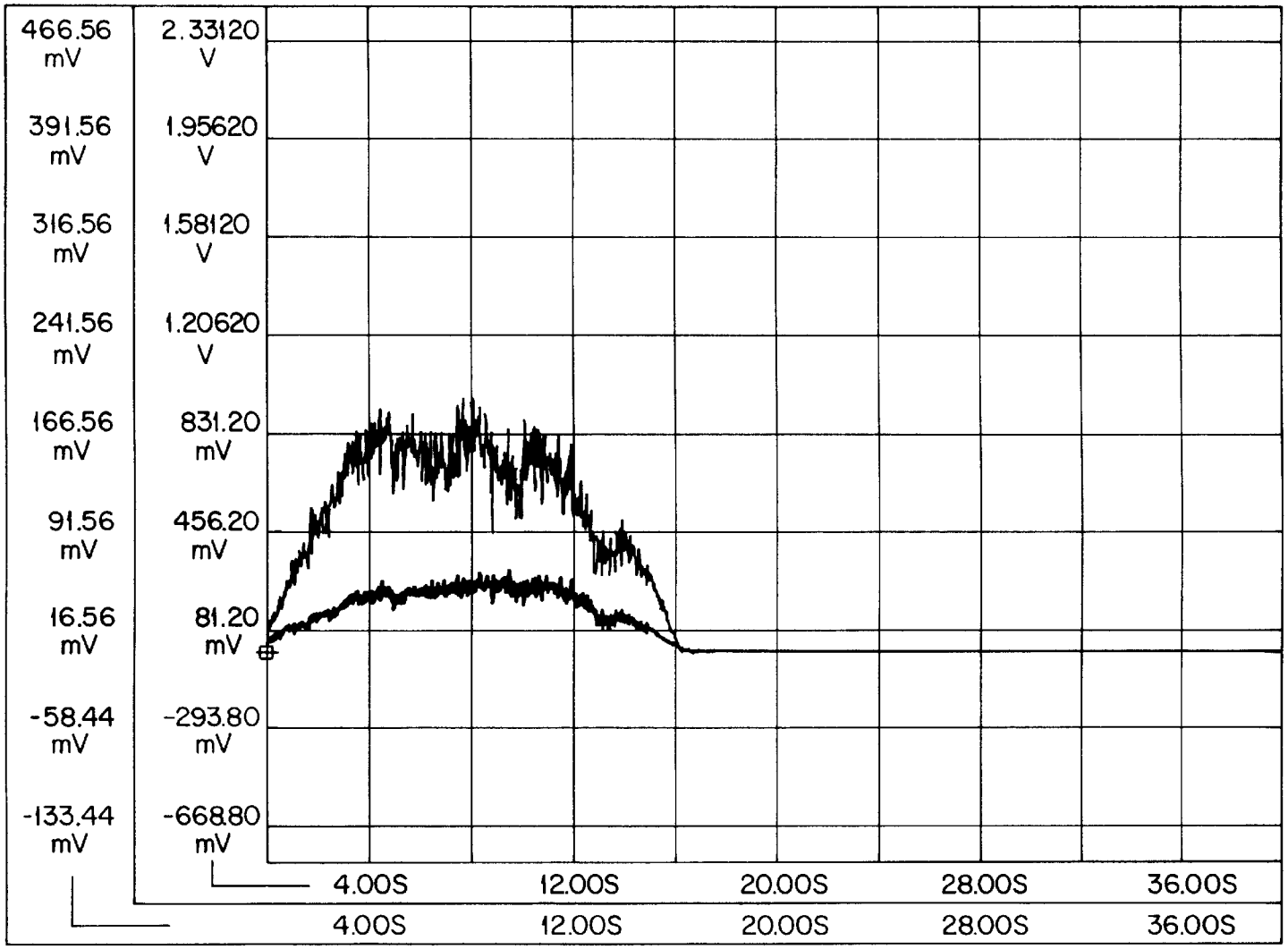
FIG. 5 is a graph showing the infrared and visible outputs of a composition within the scope of the present invention.

FIG. 5 illustrates two plots, including a plot of the output of infrared radiation over time for the composition and a plot of the output of visible radiation over time for the composition. It can be seen that a high level of infrared output was achieved shortly after burning commenced. This level was sustained over most of the operation of the sample, declining at the end of the burn. This burn rate curve is desirable. At the same time, the ratio of IR to visible was excellent.

It can be appreciated from the results achieved that an acceptable infrared emitting composition was produced and that the level of visible emissions was significantly lower than the level of infrared emissions.

Example 5

In this Example a composition within the scope of the present invention was formulated and tested. The following ingredients were mixed to produce an infrared emitting composition:

| Material | Percentage (by weight) |
|---|---|
| $KNO_3$ | 35.0 |
| $CsNO_3$ | 35.0 |
| Si | 10.0 |
| Witco premix | 20.0 |

The composition was burned and the following results were obtained and are the average for four separate tests:

| | |
|---|---|
| Burntime | 24.15 seconds |
| Burnrate | 0.0234 m/sec. |
| Avg. IR | 393.10 mV |
| Avg. Vis. | 31.63 mV |
| Avg. IR | 9.57 V sec. |
| Avg. Vis. | 0.781 V sec. |
| IR/Vis. | 12.24 |

Figure 6:
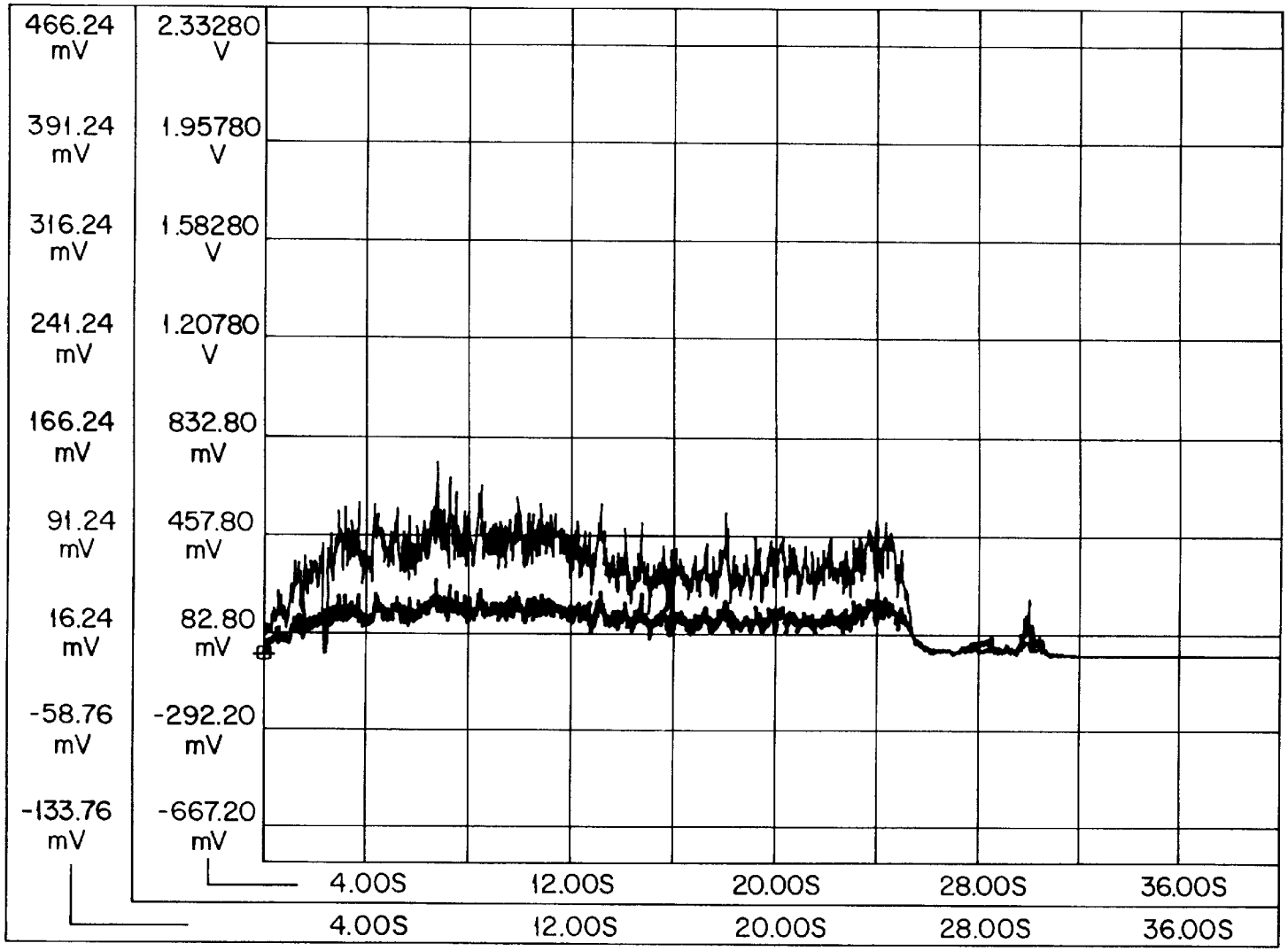
FIG. 6 is a graph showing the infrared and visible outputs of a composition within the scope of the present invention.

FIG. 6 illustrates two plots, including a plot of the output of infrared radiation over time for the composition and a plot of the output of visible radiation over time for the composition. It can be seen that a high level of infrared output was achieved shortly after burning commenced. This level was sustained over most of the operation of the sample, declining at the end of the burn. This burn rate curve is desirable. At the same time, the ratio of IR to visible was excellent.

It can be appreciated from the results achieved that an acceptable infrared emitting composition was produced and that the level of visible emissions was significantly lower than the level of infrared emissions.

Example 6

In this Example a composition within the scope of the present invention was formulated and tested. The following ingredients were mixed to produce an infrared emitting composition:

| Material | Percentage (by weight) |
|---|---|
| $CsNO_3$ | 52.5 |
| $KNO_3$ | 17.5 |
| Si | 20.0 |
| Witco premix | 20.0 |

The composition was burned and the following results were obtained and are the average for four separate tests:

| | |
|---|---|
| Burntime | 19.12 second |
| Burnrate | 0.0295 m/sec. |

-continued

| | |
|---|---|
| Avg. IR | 503.15 mV |
| Avg. Vis. | 35.54 mV |
| Area. IR | 9.70 V sec. |
| Area. Vis. | 0.694 V sec. |
| IR/Vis. | 13.97 |

Figure 7:
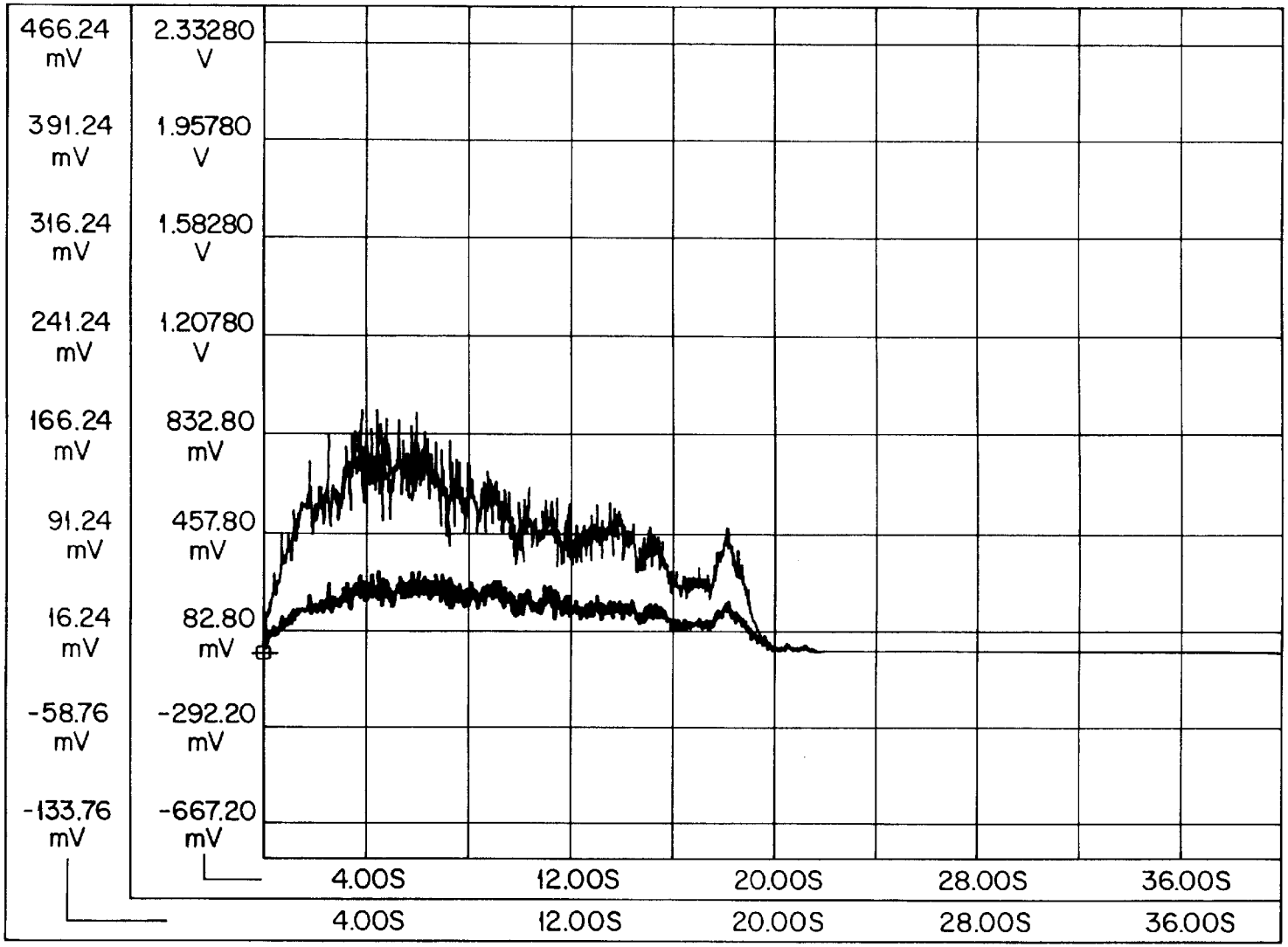
FIG. 7 is a graph showing the infrared and visible outputs of a composition within the scope of the present invention.

FIG. 7 illustrates two plots, including a plot of the output of infrared radiation over time for the composition and a plot of the output of visible radiation over time for the composition. It can be seen that a high level of infrared output was achieved shortly after burning commenced. This level was sustained over most of the operation of the sample, declining at the end of the burn. This burn rate curve is desirable. At the same time, the ratio of IR to visible was excellent.

It can be appreciated from the results achieved that an acceptable infrared emitting composition was produced and that the level of visible emissions was significantly lower than the level of infrared emissions.

Example 7

In this Example a composition within the scope of the present invention was formulated and tested. The following ingredients were mixed to produce an infrared emitting composition:

| Material | Percentage (by weight) |
|---|---|
| $CsNO_3$ | 35.0 |
| $KNO_3$ | 37.0 |
| Si | 10.0 |
| Witco premix | 18.0 |

The composition was burned and the ratio of infrared light to visible light produced was approximately 12.0.

Example 8

In this example, a composition within the scope of the present invention was tested in terms of aging, and compared to a hexamine-containing control formulation. Standard temperature and humidity aging tests were preformed.

The composition within the scope of the present invention contained Witco binder and $KNO_3$. The control composition contained Witco binder, hexamine, and $KNO_3$. The compositions were formed into standard flares and were aged pursuant to military standard MIL-STD-331B, temperature and humidity cycle single chamber method. The flares were conditioned for two consecutive 14-day cycles, for a total of 28 days. Flight and tower tests were performed. It was observed that the control developed cracking at several locations, while the composition within the scope of the invention exhibited no apparent physical change or performance degradation.

Three flares of each type were tested, and visible energy, infrared energy, and burn rate data were collected.

After the first 14-day cycle, one flare from each formulation was dissected. Two flares were burned. The most notable change was an increase in chunking by the control.

After the full 28-day cycle, one flare from each formulation was dissected. The control was found to have four grain cracks, while the formulation tested had none.

Two flares were burned to measure performance. Data for the baseline, 14-day, and 28-day cycle tests are as shown below:

Control

| | Baseline | 14-Day Cycle | 28-Day Cycle |
|---|---|---|---|
| Average IR | 2.15 V | 2.19 V | 2.293 V |
| Average Vis. | 315 mV | 303 mV | 304 mV |
| IR/Vis. | 6.8 | 7.2 | 7.5 |
| Burnrate | 0.043 in/sec | 0.041 in/sec | 0.042 in/sec |
| Burntime-tower | 320 sec | 311 sec | 317 sec |
| Burntime-flight | 201 sec | — | — |
| grain cracks | 0 | 3 | 4 |
| flight chunks | 1 | — | — |
| tower chunks | 0 | 1 | 2 |

Test Composition

| | Baseline | 14-Day Cycle | 28-Day Cycle |
|---|---|---|---|
| Average IR | 1.30 V | 1.30 V | 0.94 V |
| Average Vis. | 260 mV | 257 mV | 191 mV |
| IR/Vis. | 5.0 | 5.1 | 4.9 |
| Burnrate | 0.045 in/sec | 0.047 in/sec | 0.043 in/sec |
| Burntime-tower | 306 sec | 276 sec | 308 sec |
| Burntime-flight | 236 sec | — | — |
| grain cracks | 0 | 0 | 0 |
| flight chunks | 0 | — | — |
| tower chunks | 0 | 0 | 0 |

Accordingly, it can be seen that compositions within the scope of the present invention provide significantly improved aging characteristics. No chunking or cracking was observed using the invention composition. Using the hexamine-containing control, however, cracking and chunking were observed over the course of the tests.

SUMMARY

In summary, the present invention provides new and useful illuminant formulations which produce large quantities of infrared radiation, but produce relatively small quantities of visible light. Accordingly, some of the major drawbacks with known infrared producing materials are avoided.

The compositions of the present invention have high burn rates. The compositions emit infrared while producing only limited soot and, therefore, limited visible light is produced. The compositions of the present invention also substantially eliminate chunking. The compositions do not significantly degrade with age, even when stored at relatively elevated temperatures. Thus, the compositions of the present invention represent a significant advancement in the art.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An infrared producing composition consisting essentially of:

from about 40% to about 90% by weight of total oxidizer, wherein said oxidizer is selected from the group consisting of alkali metal oxidizer salts which produce infrared radiation upon burning, of which at least approximately 25% by weight of the infrared producing composition is cesium nitrate oxidizer salt;

a castable and clean burning binder in an amount of from about 10% to about 50% by weight; and an effective amount of at least one material which serves as a combustion rate catalyst, wherein said material is at least one selected from the group consisting of boron and silicon;

wherein the ingredients of said infrared producing composition are selected such that upon burning, the ratio of infrared radiation to visible radiation is not less than approximately 6.0, the burn rate of the composition is not less than approximately 0.060 inches/second and the infrared producing composition, when uncured, is castable and pourable in liquid form into a mold.

2. An infrared producing composition as defined in claim 1 wherein said alkali metal oxidizer salts are selected from the group consisting of potassium nitrate, cesium nitrate, and rubidium nitrate.

3. A composition according to claim 1, wherein the ratio of infrared radiation to visible radiation is greater than approximately 10.

4. A composition according to claim 1, wherein said binder is selected from the group consisting of polymers having continuous carbon chains of 1 to 6 molecules linked together by linkages selected from the groups consisting of ether, amine, ester and amide linkages.

5. A composition according to claim 1, wherein said infrared illuminant composition contains not less than 30% by weight cesium nitrate.

6. A composition according to claim 1, wherein said oxidizer consists essentially of 70% cesium nitrate, and silicon is present in approximately 10%.

7. An infrared producing composition according to claim 1, wherein said composition contain between 0% and 20% silicon.

8. An infrared producing composition according to claim 1, wherein said composition contains boron between 0 wt. % and 10 wt. %.

9. An infrared producing composition according to claim 1, wherein the ratio of infrared radiation to visible radiation is in the range of from approximately 10 to approximately 20.

10. A castable illuminant composition which produces infrared radiation upon burning, said castable illuminant composition consisting essentially of:

from about 40% to about 90% by weight oxidizer, wherein said oxidizer is a potassium salt, cesium salt, rubidium salt, or a combination thereof, provided that said castable illuminant composition is formulated with at least 25% by weight of said cesium oxidizer salt;

from about 10% to about 50% by weight polymeric binder consisting essentially of polyester, polyether, polyamine, or polyamide;

a combustion rate catalyst which consists essentially of silicon in amount less than 25% by weight of said castable illuminant composition;

wherein the ingredients of said castable illuminant composition are selected such that upon burning the ratio of infrared radiation to visible radiation is not less than approximately 6.0, the burn rate of the composition is not less than approximately 0.060 inches/second, and the castable illuminant composition, when uncured, is pourable in liquid form into a mold.

11. A composition according to claim 10, wherein said binder consists essentially of a polyester.

12. A composition according to claim 10, wherein said binder consists essentially of a polyether.

13. A compositions according to claim 10, wherein said binder consists essentially of a polyamine.

14. A composition according to claim 10, wherein said binder consists essentially of a polyamide.

15. A castable illuminant composition according to claim 10 wherein, upon burning, the ratio of infrared radiation to visible radiation is from approximately 10 to approximately 20.

16. An illuminant composition which produces infrared radiation upon burning, said illuminant composition consisting essentially of:

from about 40% to about 90% by weight oxidizer, wherein said oxidizer is a potassium salt, cesium salt, rubidium salt, or a combination thereof, provided that said castable illuminant composition is formulated with at least 25% by weight of said cesium oxidizer salt;

a castable and clean burning binder in an amount of from 10% to about 50% by weight;

combustion rate catalyst which consists essentially of at least one of silicon in an amount of between 0 wt. % to 25 wt. % or boron in an amount of between 0 wt. % to 10 wt. %;

wherein the ingredients of the illuminant composition are selected such that upon burning the ratio of infrared radiation to visible radiation is not less than approximately 6.0, the burn rate of the composition is not less than approximately 0.060 inches/second, and the illuminant composition, when uncured, is castable and pourable in liquid form into a mold.

17. An illuminant composition according to claim 16, wherein the ratio of infrared radiation to visible radiation is from approximately 10 to approximately 20.

18. A composition obtained by casting and curing a composition according to claim 1, 10 or 16.

* * * * *